US010246932B2

(12) United States Patent
Arendts

(10) Patent No.: US 10,246,932 B2
(45) Date of Patent: Apr. 2, 2019

(54) DEPLOYABLE SANDWICH-LIKE SHELL STRUCTURAL SYSTEM

(71) Applicant: James G. Arendts, Thayne, WY (US)

(72) Inventor: James G. Arendts, Thayne, WY (US)

( * ) Notice: Subject to any disclaimer, the term of this patent is extended or adjusted under 35 U.S.C. 154(b) by 443 days.

(21) Appl. No.: 15/131,983

(22) Filed: Apr. 18, 2016

(65) Prior Publication Data

US 2017/0298678 A1 Oct. 19, 2017

(51) Int. Cl.
*E06B 3/44* (2006.01)
*E06B 3/46* (2006.01)
*B63H 9/04* (2006.01)

(52) U.S. Cl.
CPC ..... *E06B 3/44* (2013.01); *B63H 9/04* (2013.01); *E06B 3/46* (2013.01)

(58) Field of Classification Search
None
See application file for complete search history.

(56) References Cited

U.S. PATENT DOCUMENTS 4,313,422 A * 2/1982 McEntee ..... F24J 2/145 126/624
4,997,021 A * 3/1991 Brutsaert ..... E04F 10/0618 135/88.11
5,139,603 A * 8/1992 Kunz ..... B29C 53/285 156/205
8,312,653 B2 * 11/2012 Fritsche ..... G09F 15/0062 160/135
9,156,568 B1 * 10/2015 Spence ..... B64G 1/44
10,189,582 B1 * 1/2019 Spence ..... B64G 1/222
2008/0191511 A1 * 8/2008 Neuer ..... B60J 11/02 296/98
2009/0104411 A1 * 4/2009 Endres ..... B32B 3/12 428/195.1
2009/0272043 A1 * 11/2009 Zwern ..... E04B 1/34321 52/27
2010/0040817 A1 * 2/2010 Purdy ..... B29C 44/06 428/36.4
2012/0012154 A1 * 1/2012 Keller ..... B64G 1/222 136/245
2017/0233997 A1 * 8/2017 Stevenson ..... E04B 9/0414 29/426.2

* cited by examiner

*Primary Examiner* — Kevin M Bernatz

(57) ABSTRACT

One embodiment of a deployable structural system having sandwich-like shell stiffness and strength properties is constructed of an outer elastic sheet and an inner elastic sheet connected by a number of substantially rigid webs wherein hinges constitute the connections. The hinge connection spacing dimensions on the inner and outer elastic sheets differ such that the resulting assemblage may be elastically bent into a compact cylindrical configuration. Deployment is achieved through reversal of the bending process and application of sufficient external restraints such that the deployed configuration is structurally stable. Additional application embodiments are described.

1 Claim, 5 Drawing Sheets

DEPLOYABLE SANDWICH-LIKE SHELL STRUCTURAL SYSTEM

PRIOR ART—REFERENCES

The following is a tabulation of some prior art that presently appears relevant:

U.S. Patents

| Pat. No. | Kind Code | Issue Date | Patentee |
|---|---|---|---|
| 9,156,568 | B1 | 2015 Oct. 15 | Spence et al. |
| 8,857,497 | B1 | 2014 Oct. 14 | Konrad et al. |
| 8,371,070 | B2 | 2013 Feb. 12 | Jackson et al. |

Nonpatent Literature Documents

Arendts, J. G., "Load Distribution in Simply Supported Concrete Box Girder Highway Bridges," thesis presented to the Iowa State University, at Ames, Iowa, in 1969, in partial fulfillment of the requirements for the degree of Doctor of Philosophy, http://lib.dr.iastate.edu/rtd, paper 3623.

Arendts, J. G. and Sanders, W. W., Jr., "Concrete Box-Girder Bridges as Sandwich Plates," Proceedings of the American Society of Civil Engineers, Journal of the Structural Division, November, 1970.

PRIOR ART—DISCUSSION

Deployable planar or shell structures are used for a variety of applications, from satellite solar arrays to overhead doors. Other non-structural applications include awnings, blinds, or stretched flexible sheets.

Existing designs of deployable flat or curved surface structures may be generally classified into three categories: (a) those constituting a single thin elastic sheet, (b) designs comprised of a plurality of relatively rigid elongated panels hinged together and (c) a plurality of relatively rigid panels that are not connected in the stowed configuration.

The first two designs are normally stowed by winding the sheet or plurality of panels onto a cylindrical mandrel. Deployment of these structures is generally accomplished by unwinding the sheet or plurality of panels onto a guide or track. In at least one design, a permanent non-elastic deformation of the thin sheet provides self-support. Deployment of the final category is accomplished utilizing differing, generally complicated, mechanical devices which reposition the individual panels onto racks.

(a) U.S. Pat. No. 9,156,568, depicting a deployable solar panel, is representative of the single thin sheet design category. Applications for this category are limited to environments where external loading is small, such as space based solar arrays. The major disadvantage of these systems is the very limited lateral load capacity of the deployed structure, unless the overall size of the deployed structure is quite small. Also, single thin metallic sheets offer minimal insulation for heat transfer normal to the sheet surface.

(b) The hinged relatively rigid panel design category is illustrated in U.S. Pat. No. 8,857,497. Applications of this design category include overhead doors where security may be an important requirement. Also included are applications where basic weather protection is required. Here, the major disadvantage is a relatively small allowable lateral load to structure weight ratio. Also, unless some type of membrane is used to seal the hinged joints, this type of structure is not completely weather-tight.

(c) As illustrated in U.S. Pat. No. 8,371,070, the third deployable structure category is usually used where a large lateral load capacity is required. In this case, individual panels are quite heavy and complicated panel deployment or stowage devices or structures are generally required.

Sandwich plates or shells, comprised of two relatively thin elastic sheets connected by a core medium, have high lateral load to structure weight ratio and stiffness to weight ratio. Since these structures are generally quite rigid, a deployable system, utilizing conventional sandwich design, requires a plurality of hinged sandwich panel elements. Thus, this design falls into category (b) where load weight ratio is improved, but still having the non weather-tightness limitation.

Arendts (1969), as summarized in Arendts and Sanders (1970), shows that structures, such as box girder bridges, consisting of two relatively thin elastic sheets connected by a plurality of transverse webs, theoretically and actually behave as sandwich plates with orthogonally differing core transverse shear properties. Such a structural system may be modified, through hinging the web—sheet connections, so that it is deployable. Overall stiffness and strength of the deployed structure is not significantly reduced by hinging the webs and stability is achieved through proper external support of the deployed system.

SUMMARY

A deployable sandwich-like shell structural system consists of two relatively thin elastic sheets connected by a plurality of elongated web panels. These connections are hinged so that the overall structure may be compactly stowed. Stability and strength of the deployed structure is achieved through proper external support of the system.

Advantages

In the deployed configuration, this sandwich-like shell structure has the following advantages when compared with existing systems:

(a) Very large allowable transverse load to structural weight ratio, (b) Very large stiffness to structural weight ratio, (c) Weather tightness, (d) Excellent transverse heat flow insulation due to trapped air in the deployed cells, (e) Ability to easily modify the curvature of the deployed shell.

DRAWINGS—FIGURES

In the drawings, closely related figures have the same number but differing alphabetical suffixes.

DRAWINGS—REFERENCE NUMERALS

Figure 1A:
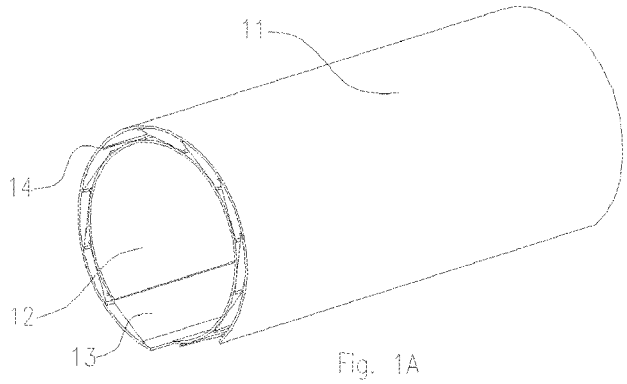
FIGS. 1A through 1C illustrate the first embodiment basic elements, geometry and detail of the structural system in the stowed and representative deployed configuration.

11 outer elastic sheet
12 inner elastic sheet
13 typical web
14 typical hinge
15 typical sheet mid-surface radius
21 typical longitudinal support means
22 typical transverse support means
31 outer sheet mid-surface radius
32 inner sheet mid-surface radius
33 web width
34 clockwise angle from normal
35 curved sheet distance
36 flat sheet distance
41 typical curved web
42 mandrel
61 relative wind direction
62 rotatable fairing
63 flexible fairing sheet

EMBODIMENT DETAILED DESCRIPTIONS

Figure 1B:
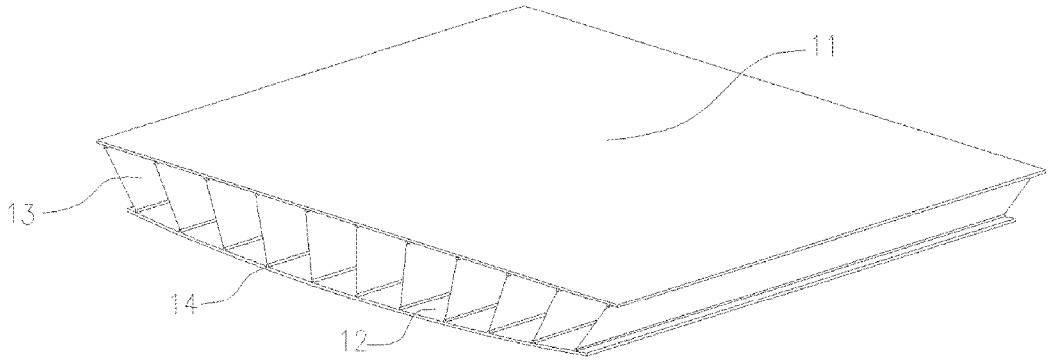
Figure 1C:
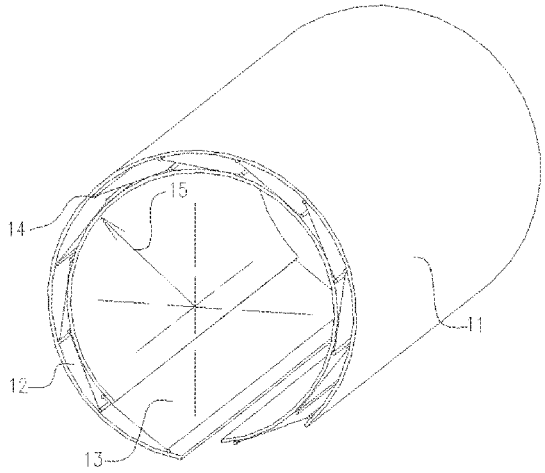
Figure 2:
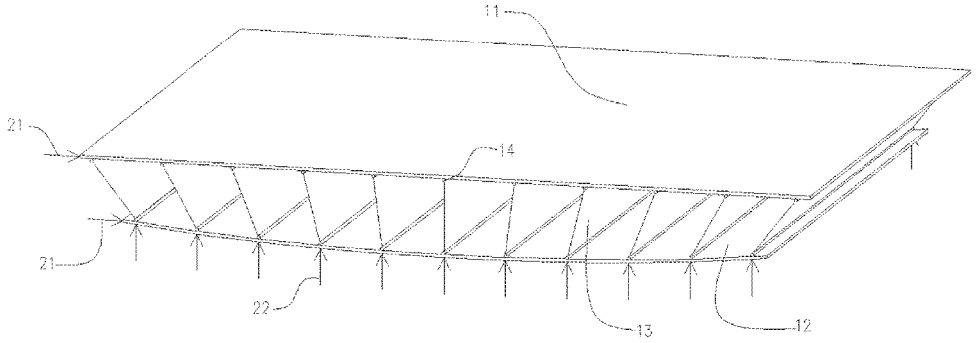
FIG. 2 illustrates a method of external supports and restraints which yields a stable deployed structural system.

First Embodiment—FIGS. 1A Through 2

This embodiment is illustrated in FIG. 1A (the embodiment in the stowed configuration) and FIG. 1B (the embodiment in the deployed configuration). An outer elastic sheet 11 is connected to an inner elastic sheet 12 by a plurality of identical high aspect ratio webs 13 by means of hinges 14. The webs are depicted as flat plates in FIGS. 1A and 1B. However, these could be of curved construction resulting in a more compact stowed configuration. As shown, the stowed sheets are bent into a cylindrical shape (generally circular).

The sheets, 11 and 12, could be comprised of homogenous metallic material or of composite construction such as fiber reinforced polymer (FRP). The webs, 13, are subject to only in-plane stresses due to bending stress relief of the hinges, and may thus be constructed of light homogeneous materials or a FRP wrapped core. The hinges, 14, could be conventional mechanical hinges or constructed of flexible polymer composite. Various methods may be employed for hinge attachment to sheets and webs, including mechanical (rivets or spot welds) or adhesives. Also, the webs may be designed to include the hinge elements so that the only attachments required are web-to-sheets.

FIG. 1C shows a more detailed view of the stowed configuration. A requirement of this embodiment is that the maximum strains in the sheets, 11 and 12, remain within an elastic design criterion of the material comprising the sheets when the embodiment is in the stowed configuration (FIG. 1C). For metallic materials, an appropriate design strain is 80 percent of the material yield strain or the endurance limit strain. For FRP materials subject to prolong strain, an appropriate design strain is the creep-rupture limit which varies from 20 to 50 percent of the ultimate rupture strain, depending on the type of fiber used in the design.

Maximum strain, emax, in a cylindrically bent elastic sheet is given by the following well known relationship:

$$e\max = t/2R,$$

where t is the thickness and R (15) is a typical radius of curvature of the bent sheet. From this relationship, a design t/R ratio is determined by equating emax with the material design strain, as determined in the preceding paragraph.

For the deployed structure to be statically stable, a means of support must be provided as shown in FIG. 2 where the supports are shown symbolically as arrows. Longitudinal (direction transverse to the hinge axes) restraint is provided by supports 21 applied to the edges of sheets 11 and 12. Transverse (direction normal to sheet 11) restraint is provided by supports 22 applied to the ends of each web. Other embodiment support requirements depend on the specific configuration of the deployed shell.

Figure 3A:
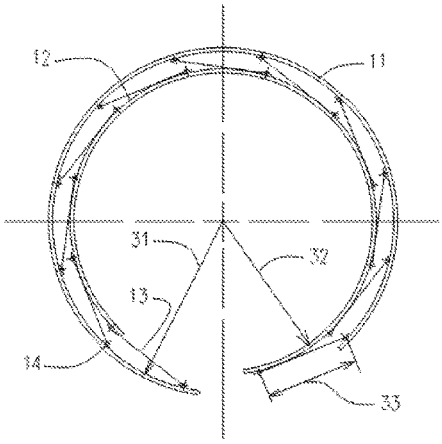
FIGS. 3A and 3B show the nomenclature utilized for preliminary design calculations for a representative deployed configuration.
Figure 3B:
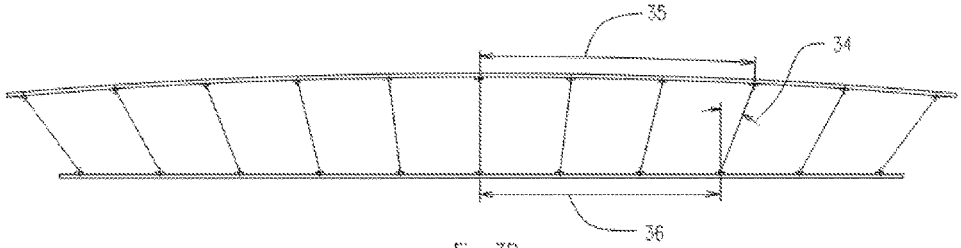

First Embodiment—Design Considerations—FIG. 3A and FIG. 3B

FIGS. 3A and 3B show dimensions and nomenclature required to illustrate relationships between the stowed and a typical deployed shell configuration. These relationships may be used for preliminary embodiment design use. FIG. 3A shows a cross-section of a stowed shell with circular cylindrical geometry and identically sized webs. FIG. 3B illustrates a typical deployed geometry cross-section where the inner sheet is constrained to be flat. Nearly exact analytical relationships are derived (derivations are too lengthy for inclusion here) for the deployment shown in FIG. 3B as well as another deployment where the outer sheet is constrained to be flat. For other deployed configurations where both inner and outer sheets are curved, numerical method design procedures may be employed.

Referring to FIGS. 3A and 3B, the following nomenclature is defined:

Ro=mid-surface radius of stowed outer sheet, 31,
Ri=mid-surface radius of stowed inner sheet, 32,
W=web width (center-hinge to center-hinge), 33,
k=Ri/Ro,
$C=W/(1-k^2)$.

Referring to FIG. 3B, for web angle, a (34), measured clockwise from a normal to 12, distances along the curved and flat surfaces, s(a) (35) and x(a) (36), are, respectively:

$$s(a)=C\{k[\sin(a)]+E(k,a)\},$$

$$x(a)=k[s(a)]$$

where E(k, angle) is the incomplete elliptic integral of the second kind which may be found in mathematical function tables or calculated numerically.

Web-to-web spacing, and thus number of webs, is independent of the geometry. This spacing is dependent on embodiment design requirements such as magnitude of design lateral loads and overall deployed configuration stiffness.

First Embodiment—Construction and Operation

Even though the specification of geometric relationships is somewhat complicated, actual embodiment construction principles are quite simple. Once materials and dimensions are chosen, the embodiment is assembled on an armature of the same dimensions as the embodiment stowed dimensions (of the same radius as R (15), FIG. 1C). The edges of both sheets (11 and 12) are first secured to the armature. The webs 13 are assembled to hinges 14. Each web-hinge assembly is then sequentially attached to both sheets as the armature is rotated. Thus, the correct relative web-to-sheet connection dimensions are automatically ensured.

Stowage of the embodiment from the deployed configuration, as illustrated in FIG. 1B, is accomplished by first translating the sheets, 11 and 12, relative to each other so that one of the end webs, 13, is flattened to be nearly parallel to either sheet. A means of torque is then applied to the outer sheet, 11, edge, which is adjacent to the flattened web, thus bending the embodiment into the stowed configuration, FIG. 1A. Deployment is accomplished by reversing the means of torque applied to the embodiment stowed configuration, FIG. 1A, thus straightening the embodiment into the deployed configuration, FIG. 1B. A means of embodiment support and guidance is employed during deployment and stowage.

In the above descriptions, the stowed overall geometry was taken to be generally circular cylindrical. However, this is not an absolute requirement; a variable curvature cylindrical configuration, such as elliptical cylindrical, could be realized through continually variable web connection spacing (i.e., variable k). Although this realization of the embodiment may not be highly useful, it is included as an independent claim.

Additional Embodiments—FIGS. 4A Through 6D

Among many possible, three additional, embodiments are briefly described. Note that the depictions of these embodiments are not to scale; stowed embodiment configuration may be shown at a more magnified scale for clarification of details.

Figure 4A:
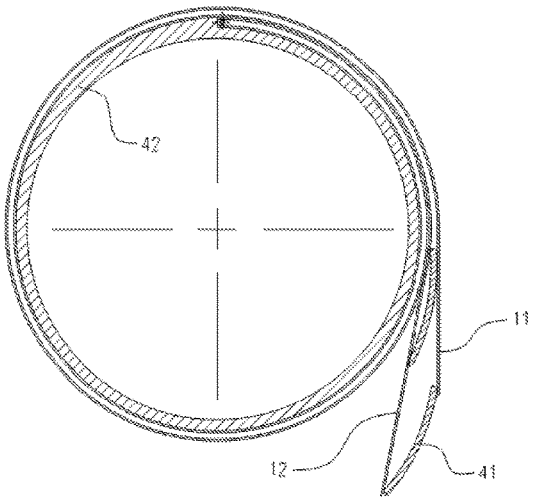
FIGS. 4A and 4B illustrate cross-sections of stowed and deployed configurations for an overhead door embodiment.
Figure 4B:
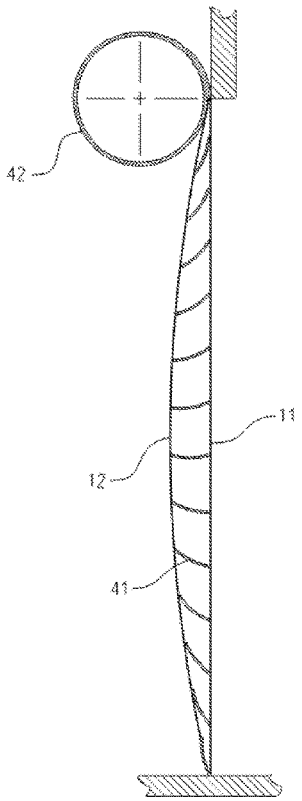

FIGS. 4A and 4B conceptually illustrate cross-sections of an overhead door embodiment where FIG. 4A shows the stowed door and FIG. 4B shows the deployed door. In this embodiment (as well as all additional embodiments), the webs, 41, are curved for a more compact stowed configuration. In addition, a nearly circular-cylindrical mandrel, 42, is utilized. For clarity, only two webs are shown in FIG. 4A with the remaining stowed webs not shown.

Both sheets, 11 and 12, are attached to the mandrel, thus providing longitudinal (transverse to webs) support to both sheets and providing the means of torque application to the embodiment. The mandrel also provides support to the stowed embodiment. Operation of the door embodiment is accomplished by a means of torque applied to the mandrel which results in rotation of the mandrel (for either stowage or deployment).

A means of lateral support (for example, a track or guide) is provided for the ends of the webs in such a manner that the outer sheet, 11, is flat in the deployed configuration for embodiment stability and a clean weather-side exposure.

A typical door embodiment of dimensions 3 m high by 10 m wide (representative of a small private plane hangar door) was structurally analyzed for 130 km/hr, normal to outer sheet, dynamic pressure wind loading. Results proved that (for thin gauge high strength aluminum used for sheets 11 and 12) the door embodiment was well-behaved with respect to both stiffness and strength.

Figure 5:
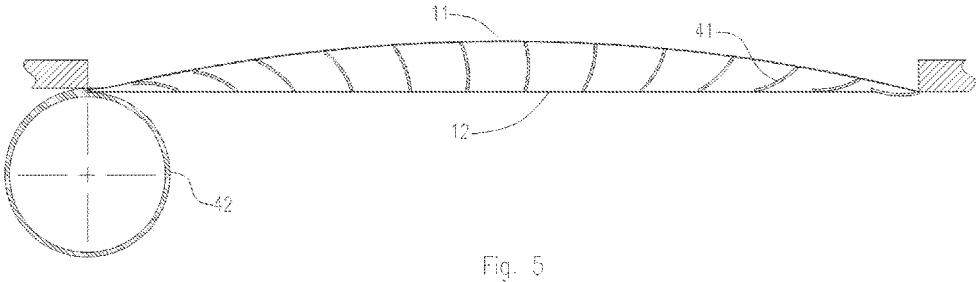
FIG. 5 illustrates a deployed configuration roof closure embodiment cross-section.

FIG. 5 conceptually illustrates a cross-section of a deployed roof closure embodiment. This is nearly the same as the overhead door embodiment rotated to a horizontal deployed configuration. The exception is that sheet 11 is curved rather than flat (as in the door embodiment) so that environmental loads such as water and snow are dispelled. This is accomplished by modification of the means of support of the web ends.

The final additional embodiment described is a wind-powered sail embodiment, as illustrated in FIGS. 6A through 6D. These figures are conceptual overhead cross-sectional views of the sail embodiment for various deployed configurations. This embodiment is similar to the previously described embodiments except that the deployed configurations have reversible camber geometry. For all figures, the large arrows, 61, represent the relative wind directions.

Figure 6A:
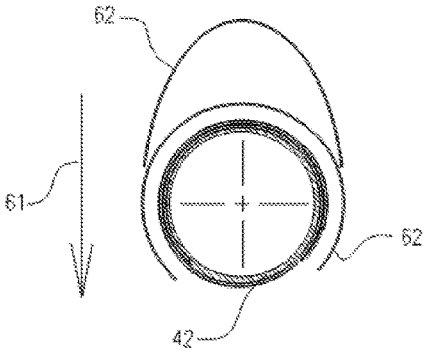
FIGS. 6A through 6D illustrate cross-sectional top views of furled and deployed configurations for a wind powered sail embodiment.

For dangerous wind conditions (storms, gales or hurricanes), FIG. 6A illustrates the furled state where the embodiment is in the stowed configuration. Also shown is a rotatable fairing, 62, employed for a more efficient overall airfoil effect.

Figure 6B:
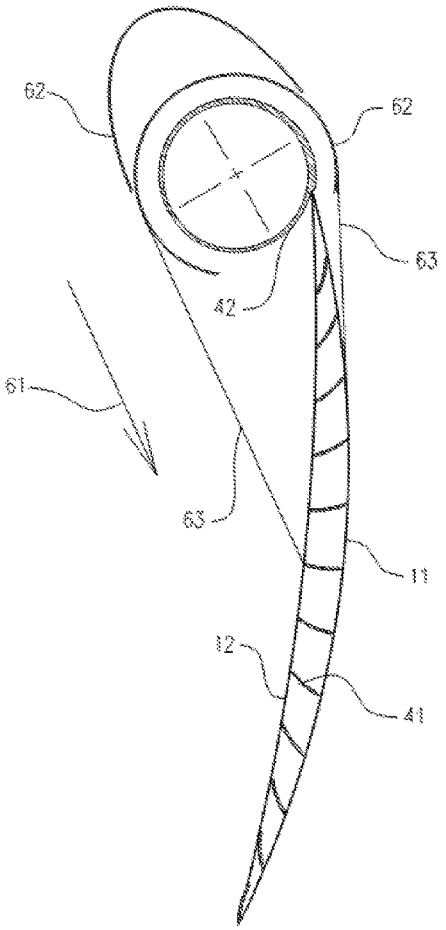

From the furled state, the embodiment may be deployed to the configuration shown in FIG. 6B, the port tack state. Fairing 62 is simultaneously rotated to the new configuration. Also shown are additional elements: flexible fairing sheets, 63, employed for a more efficient overall airfoil effect. The means of support of the web ends in this embodiment are rotating flexible tracks.

Figure 6C:
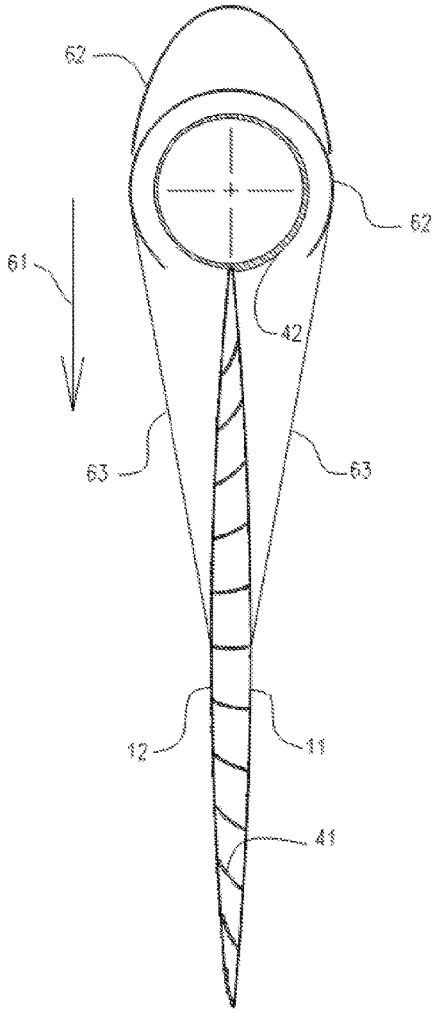

For non-dangerous, but unfavorable wind conditions, FIG. 6C illustrates the feathered state achieved by rotation of the mandrel, 42, and fairing, 62. A means of connection of 42 with said support tracks enables the deployed shell to simultaneously rotate from the port tack state to the configuration shown in FIG. 6C.

Figure 6D:
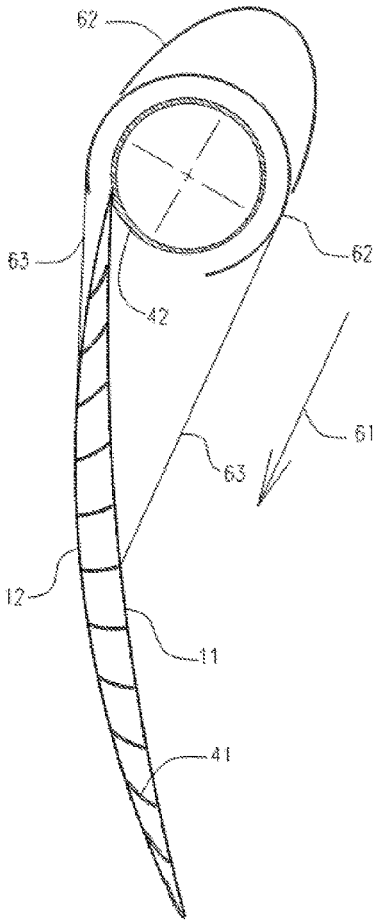

The starboard tack state, FIG. 6D, is achieved by additional rotation of 42, 62 and said support tracks which remain attached to 42. The furled state, FIG. 6A is attained by reversal of the sequence described above.

Additional Embodiments—Advantages

A number of advantages are evident in the embodiments described above:

(a) Very high stiffness and strength to weight ratios of the deployed configurations enable light weight embodiments to carry large environmental transverse loads, such as those induced by water and wind.

(b) Seamless surfaces of the deployed configurations enable the closure embodiments to be weather tight and capable of forming static pressure boundaries.

(c) Air trapped in the cells of the deployed configurations enables natural insulation of transverse heat transfer in the embodiments.

(d) In the case of the wind sail embodiment, flexibility of the deployed configurations enables the camber of the sail to be easily reversed resulting in rapid course tacks.

(e) Efficient airfoil cross-section shapes enables the wind sail embodiment to generate significant driving force for a wide variety of wind strengths and directions.

CONCLUSION, RAMIFICATIONS AND SCOPE

A deployable sandwich-like shell structural system has been disclosed. This system is simple in concept and construction, yet has many potential uses which take advantage of this system's unique capabilities:

- it has a compact stowed configuration which is easily and quickly converted to the deployed configuration;
- in its deployed configuration, it has a very large stiffness to weight ratio which enables applications requiring low weight, deformations and flutter;
- in its deployed configuration, it has a very high lateral load strength to weight ratio which enables applications requiring low weight and high resistance to lateral environmental loading;
- in its deployed configuration, it has good natural insulation to transverse heat flow due to air trapped in the internal cells of the shell;

in its deployed configuration, it is weather tight and capable, with proper edge sealing, of forming a differential pressure barrier such could be used in an ultra-clean environment boundary; and in its deployed configuration, with proper moveable lateral edge support, curvature of the shell surfaces may be varied or reversed which has application to airfoil design usage.

Although the above discussion contains many specificities, these should not be construed as limiting the scope of the embodiments, but as merely providing illustrations of some of several embodiments. Thus the scope of the embodiments should be determined by the appended claims and their legal equivalents, rather than by the examples given.

I claim:

1. A deployable structurally composite cellular shell assemblage, comprising:

a. a first elastic sheet, b. a second elastic sheet substantially parallel to said first elastic sheet, c. a plurality of elongated hinges, d. a plurality of substantially rigid elongated webs having at least two elongated edges, each of which is attached in a parallel manner, along both elongated edges, to said first and second elastic sheets by means of said hinges, where the spacing of said hinge connections, as measured on the surface of said first elastic sheet, differs from the spacing of said hinge connections, as measured on the surface of said second elastic sheet, thus sandwiching said webs between said elastic sheets, and e. a first means of transverse restraint, at right angles to said sheets, supporting the ends of said webs; and a second means of longitudinal restraint, at right angles to said hinges and in the plain of said elastic sheets, supporting one edge, parallel to said webs, of both of said elastic sheets, thus providing enhanced structural bending strength and stability to the deployed assemblage described above, whereby the differing spacing of said hinge connections to said first elastic sheet from spacing of said hinge connections to said second elastic sheet enables said sheets and webs to be elastically urged into a substantially circular cylindrical configuration resulting in compact cylindrical stowage of said structural assemblage; with reversal of said sheet stowage and utilization of said support means resulting in deployment, stability and enhanced structural bending strength of said structural assemblage.

* * * * *